US008056635B2

(12) United States Patent
Shampine et al.

(10) Patent No.: US 8,056,635 B2
(45) **Date of Patent: *Nov. 15, 2011**

(54) SPLIT STREAM OILFIELD PUMPING SYSTEMS

(75) Inventors: Rod Shampine, Houston, TX (US); Paul Dwyer, Houston, TX (US); Ronnie Stover, Houston, TX (US); Mike Lloyd, Katy, TX (US); Jean-Louis Pessin, Amiens (FR); Edward Leugemors, Sugar Land, TX (US); Larry D. Welch, Missouri City, TX (US); Joe Hubenschmidt, Sugar Land, TX (US); Philippe Gambier, Houston, TX (US); William Troy Huey, Elk City, OK (US); Tom Allan, Moscow (RU)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/958,716

(22) Filed: Dec. 2, 2010

(65) Prior Publication Data

US 2011/0067885 A1 Mar. 24, 2011

Related U.S. Application Data

(63) Continuation of application No. 11/754,776, filed on May 29, 2007, now Pat. No. 7,845,413.

(51) Int. Cl.
*E21B 43/04* (2006.01)
*E21B 43/267* (2006.01)

(52) U.S. Cl. ..... 166/369; 166/308.1; 166/68.5; 166/105

(58) Field of Classification Search ..... 166/369, 166/308.1, 68, 68.5, 105; 415/199.1, 199.2, 415/199.6; 366/160.2
See application file for complete search history.

(56) References Cited

U.S. PATENT DOCUMENTS

| | | | |
|---|---|---|---|
| 2,876,839 | A | 3/1959 | Fast et al. |
| 3,560,053 | A | 2/1971 | Ortloff |
| 3,722,595 | A | 3/1973 | Kiel |
| 3,842,910 | A | 10/1974 | Zingg et al. |
| 4,534,427 | A | 8/1985 | Wang et al. |
| 4,726,734 | A | 2/1988 | Zientek et al. |
| 5,133,624 | A | 7/1992 | Cahill |
| 5,553,998 | A | 9/1996 | Muhlhoff et al. |
| 5,570,743 | A | 11/1996 | Padgett et al. |
| 5,720,598 | A | 2/1998 | de Chizzelle |
| 5,799,734 | A | 9/1998 | Norman et al. |
| 5,961,282 | A | 10/1999 | Wittrisch et al. |
| 6,637,517 | B2 | 10/2003 | Samuel et al. |
| 6,701,955 | B2 | 3/2004 | McIntire et al. |
| 2005/0056428 | A1 | 3/2005 | Jeffrey, Jr. |
| 2005/0219945 | A1 | 10/2005 | Kelley et al. |
| 2006/0065400 | A1 | 3/2006 | Smith |
| 2007/0059166 | A1 | 3/2007 | Sheth et al. |

*Primary Examiner* — William P Neuder
(74) *Attorney, Agent, or Firm* — Michael Dae; David Cate; Robin Nava

(57) ABSTRACT

A method of pumping an oilfield fluid from a well surface to a wellbore is provided that includes providing a clean stream; operating one or more clean pumps to pump the clean stream from the well surface to the wellbore; providing a dirty stream including a solid material disposed in a fluid carrier; and operating one or more dirty pumps to pump the dirty stream from the well surface to the wellbore, wherein the clean stream and the dirty stream together form said oilfield fluid.

18 Claims, 9 Drawing Sheets

SPLIT STREAM OILFIELD PUMPING SYSTEMS

CROSS-REFERENCE TO RELATED APPLICATION

This application is a continuation application of U.S. Non-Provisional application Ser. No. 11/754,776 that is scheduled to issue on Dec. 7, 2010 as U.S. Pat. No. 7,845,413 and claims priority under 35 U.S.C. §119(e) to U.S. Provisional Application Ser. No. 60/803,798, filed on Jun. 2, 2006, which is incorporated herein by reference.

FIELD OF THE INVENTION

The present invention relates generally to a pumping system for pumping a fluid from a surface of a well to a wellbore at high pressure, and more particularly to a such a system that includes splitting the fluid into a clean stream having a minimal amount of solids and a dirty stream having solids in a fluid carrier.

BACKGROUND

In special oilfield applications, pump assemblies are used to pump a fluid from the surface of the well to a wellbore at extremely high pressures. Such applications include hydraulic fracturing, cementing, and pumping through coiled tubing, among other applications. In the example of a hydraulic fracturing operation, a multi-pump assembly is often employed to direct an abrasive containing fluid, or fracturing fluid, through a wellbore and into targeted regions of the wellbore to create side "fractures" in the wellbore. To create such fractures, the fracturing fluid is pumped at extremely high pressures, sometimes in the range of 10,000 to 15,000 psi or more. In addition, the fracturing fluid contains an abrasive proppant which both facilitates an initial creation of the fracture and serves to keep the fracture "propped" open after the creation of the fracture. These fractures provide additional pathways for underground oil and gas deposits to flow from underground formations to the surface of the well. These additional pathways serve to enhance the production of the well.

Plunger pumps are typically employed for high pressure oilfield pumping applications, such as hydraulic fracturing operations. Such plunger pumps are sometimes also referred to as positive displacement pumps, intermittent duty pumps, triplex pumps or quintuplex pumps. Plunger pumps typically include one or more plungers driven by a crankshaft toward and away from a chamber in a pressure housing (typically referred to as a "fluid end") in order to create pressure oscillations of high and low pressures in the chamber. These pressure oscillations allow the pump to receive a fluid at a low pressure and discharge it at a high pressure via one way valves (also called check valves).

Multiple plunger pumps are often employed simultaneously in large scale hydraulic fracturing operations. These pumps may be linked to one another through a common manifold, which mechanically collects and distributes the combined output of the individual pumps. For example, hydraulic fracturing operations often proceed in this manner with perhaps as many as twenty plunger pumps or more coupled together through a common manifold. A centralized computer system may be employed to direct the entire system for the duration of the operation.

However, the abrasive nature of fracturing fluids is not only effective in breaking up underground rock formations to create fractures therein, it also tends to wear out the internal components of the plunger pumps that are used to pump it. Thus, when plunger pumps are used to pump fracturing fluids, the repair, replacement and/or maintenance expenses for the internal components of the pumps are extremely high, and the overall life expectancy of the pumps is low.

For example, when a plunger pump is used to pump a fracturing fluid, the pump fluid end, valves, valve seats, packings, and plungers require frequent maintenance and/or replacement. Such a replacement of the fluid end is extremely expensive, not only because the fluid end itself is expensive, but also due to the difficulty and timeliness required to perform the replacement. Valves, on the other hand are relatively inexpensive and relatively easy to replace, but require such frequent replacements that they comprise a large percentage of plunger pump maintenance expenses. In addition, when a valve fails, the valve seat is often damaged as well, and seats are much more difficult to replace than valves due to the very large forces required to pull them out of the fluid end. Accordingly, a need exists for an improved system and method of pumping fluids from a well surface to a wellbore.

SUMMARY

In one embodiment, the present invention includes splitting a fracturing fluid stream into a clean stream having a minimal amount of solids and a dirty stream having solids in a fluid carrier, wherein the clean stream is pumped from the well surface to a wellbore by one or more clean pumps and the dirty stream is pumped from the well surface to a wellbore by one or more dirty pumps, thus greatly increasing the useful life of the clean pumps.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION OF EMBODIMENTS OF THE INVENTION

Embodiments of the present invention relate generally to a pumping system for pumping a fluid from a surface of a well to a wellbore at high pressures, and more particularly to such a system that includes splitting the fluid into a clean stream having a minimal amount of solids and a dirty stream having solids in a fluid carrier. In one embodiment, both the clean stream and the dirty stream are pumped by the same type of pump. For example, in one embodiment one or more plunger pumps are used to pump each fluid stream. In another embodiment, the clean stream and the dirty stream are pumped by different types of pumps. For example, in one embodiment one or more plunger pumps are used to pump the dirty stream and one or more horizontal pumps (such as a centrifugal pump or a progressive cavity pump) are used to pump the clean fluid stream.

Figure 1:
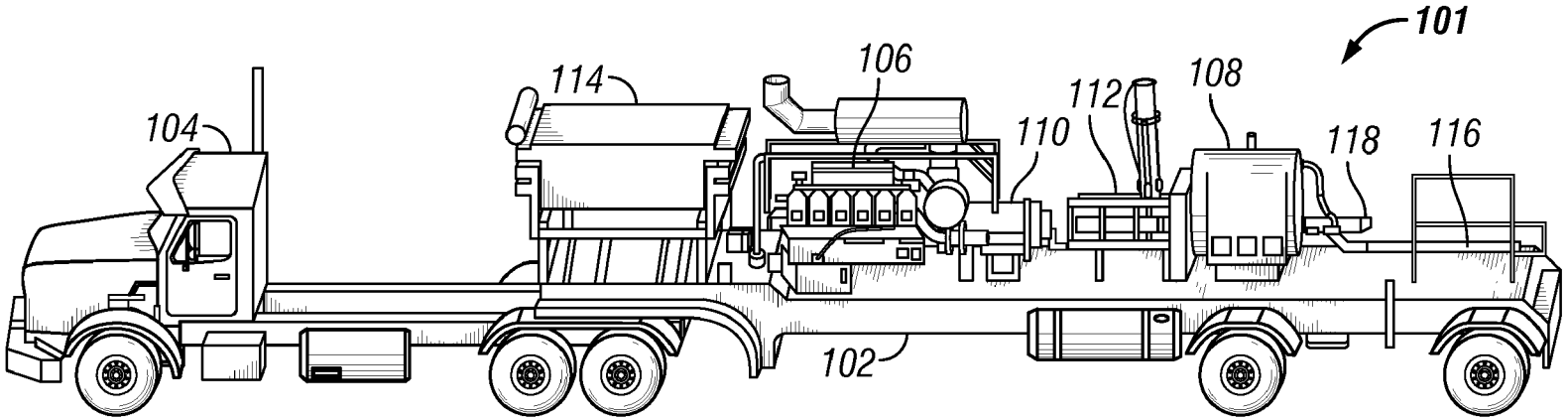
FIG. 1 is side view of a plunger pump for use in a pump system according to one embodiment of the present invention.

FIG. 1 shows a plunger pump 101 for pumping a fluid from a well surface to a wellbore. As shown, the plunger pump 101 is mounted on a standard trailer 102 for ease of transportation by a tractor 104. The plunger pump 101 includes a prime mover 106 that drives a crankshaft through a transmission 110 and a drive shaft 112. The crankshaft, in turn, drives one or more plungers toward and away from a chamber in the pump fluid end 108 in order to create pressure oscillations of high and low pressures in the chamber. These pressure oscillations allow the pump to receive a fluid at a low pressure and discharge it at a high pressure via one way valves (also called check valves). Also connected to the prime mover 106 is a radiator 114 for cooling the prime mover 106. In addition, the plunger pump fluid end 108 includes an intake pipe 116 for receiving fluid at a low pressure and a discharge pipe 118 for discharging fluid at a high pressure.

Figure 2:
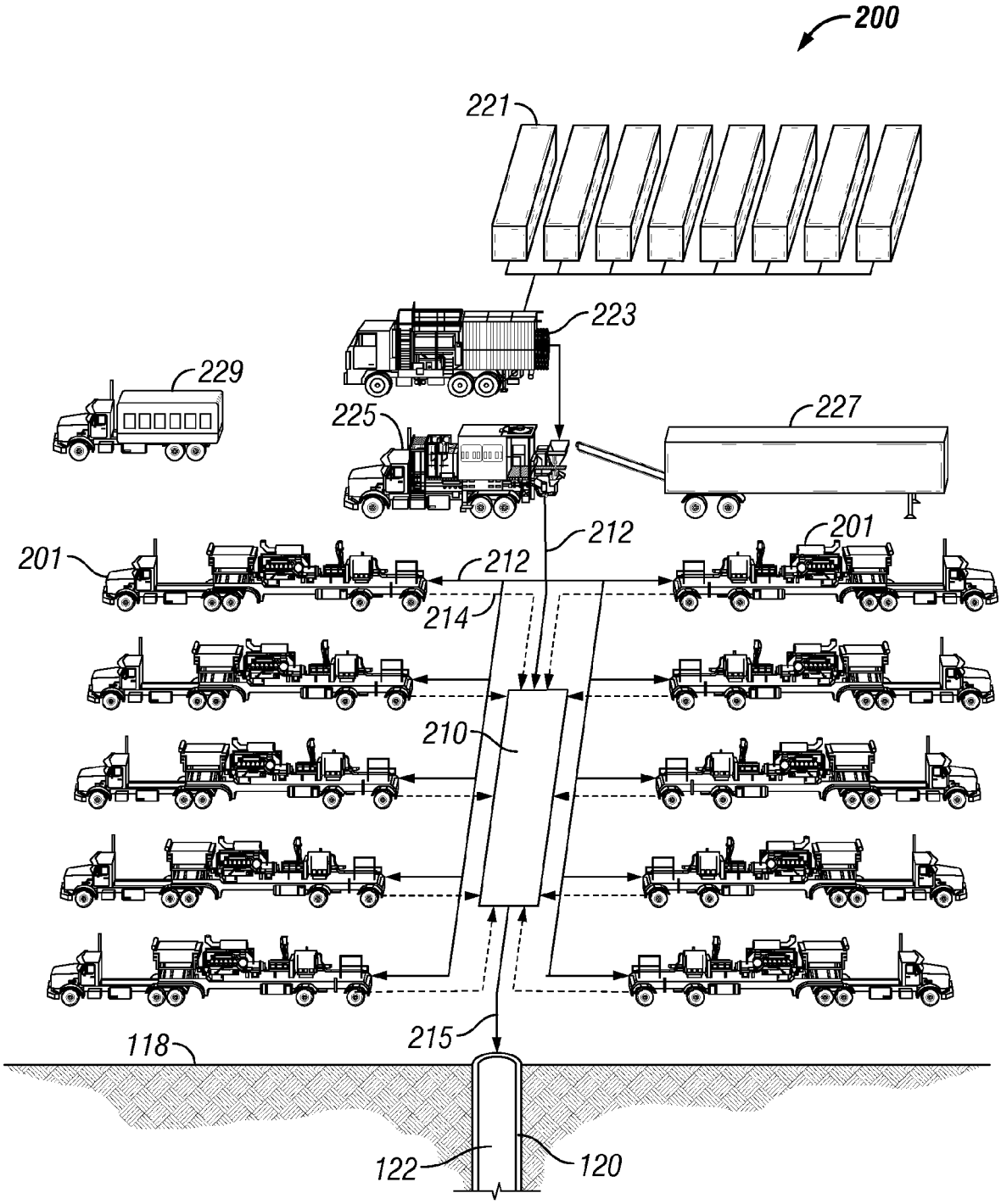
FIG. 2 (Prior Art)
FIG. 2 is a schematic representation of a pump system for performing a hydraulic fracturing operation on a well according to one embodiment of the prior art.

FIG. 2 shows an prior art pump system 200 for pumping a fluid from a surface 118 of a well 120 to a wellbore 122 during an oilfield operation. In this particular example, the operation is a hydraulic fracturing operation, and hence the fluid pumped is a fracturing fluid. As shown, the pump system 200 includes a plurality of water tanks 221, which feed water to a gel maker 223. The gel maker 223 combines water from the tanks 221 with a gelling agent to form a gel. The gel is then sent to a blender 225 where it is mixed with a proppant from a proppant feeder 227 to form a fracturing fluid. The gelling agent increases the viscosity of the fracturing fluid and allows the proppant to be suspended in the fracturing fluid. It may also act as a friction reducing agent to allow higher pump rates with less frictional pressure.

The fracturing fluid is then pumped at low pressure (for example, around 60 to 120 psi) from the blender 225 to a plurality of plunger pumps 201 as shown by solid lines 212. Note that each plunger pump 201 in the embodiment of FIG. 2 may have the same or a similar configuration as the plunger pump 101 shown in FIG. 1. As shown in FIG. 2, each plunger pump 201 receives the fracturing fluid at a low pressure and discharges it to a common manifold 210 (sometimes called a missile trailer or missile) at a high pressure as shown by dashed lines 214. The missile 210 then directs the fracturing fluid from the plunger pumps 201 to the wellbore 122 as shown by solid line 215.

In a typical hydraulic fracturing operation, an estimate of the well pressure and the flow rate required to create the desired side fractures in the wellbore is calculated. Based on this calculation, the amount of hydraulic horsepower needed from the pumping system in order to carry out the fracturing operation is determined. For example, if it is estimated that the well pressure and the required flow rate are 6000 psi (pounds per square inch) and 68 BPM (Barrels Per Minute), then the pump system 200 would need to supply 10,000 hydraulic horsepower to the fracturing fluid (i.e., 6000*68/40.8).

In one embodiment, the prime mover 106 in each plunger pump 201 is an engine with a maximum rating of 2250 brake horsepower, which, when accounting for losses (typically about 3% for plunger pumps in hydraulic fracturing operations), allows each plunger pump 201 to supply a maximum of about 2182 hydraulic horsepower to the fracturing fluid. Therefore, in order to supply 10,000 hydraulic horsepower to a fracturing fluid, the pump system 200 of FIG. 2 would require at least five plunger pumps 201.

However, in order to prevent an overload of the transmission 110, between the engine 106 and the fluid end 108 of each plunger pump 201, each plunger pump 201 is normally operated well under is maximum operating capacity. Operating the pumps under their operating capacity also allows for one pump to fail and the remaining pumps to be run at a higher speed in order to make up for the absence of the failed pump.

As such in the example of a fracturing operation requiring 10,000 hydraulic horsepower, bringing ten plunger pumps 201 to the wellsite enables each pump engine 106 to be operated at about 1030 brake horsepower (about half of its maximum) in order to supply 1000 hydraulic horsepower individually and 10,000 hydraulic horsepower collectively to the fracturing fluid. On the other hand, if only nine pumps 201 are brought to the wellsite, or if one of the pumps fails, then each of the nine pump engines 106 would be operated at about 1145 brake horsepower in order to supply the required 10,000 hydraulic horsepower to the fracturing fluid. As shown, a computerized control system 229 may be employed to direct the entire pump system 200 for the duration of the fracturing operation.

As discussed above, a problem with this pump system 200 is that each plunger pump 201 is exposed to the abrasive proppant of the fracturing fluid. Typically the concentration of the proppant in the fracturing fluid is about 2 to 12 pounds per gallon. As mentioned above, the proppant is extremely destructive to the internal components of the plunger pumps 201 and causes the useful life of these pumps 201 to be relatively short.

Figure 3:
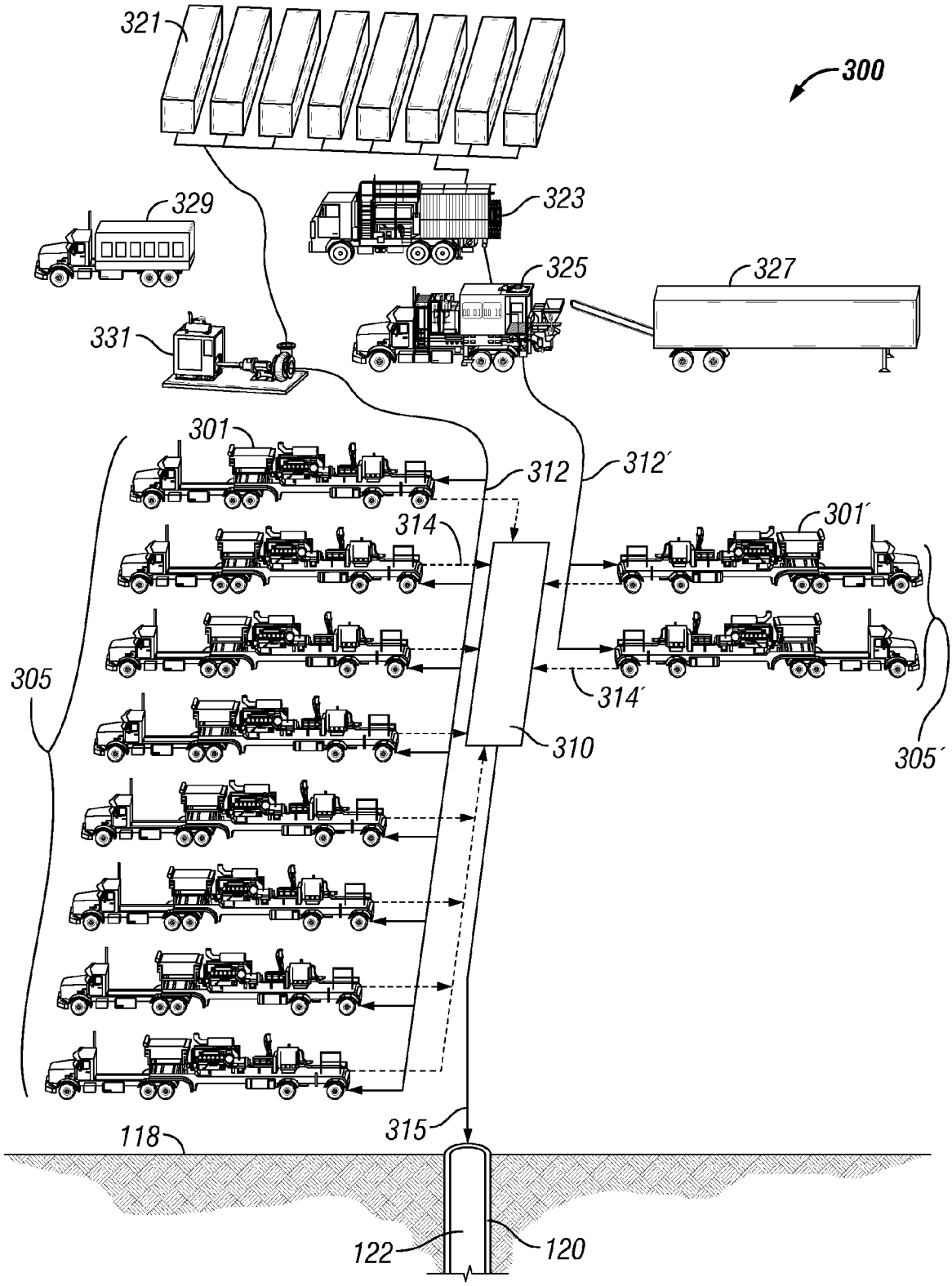
FIG. 3 is a schematic representation of a pump system for pumping a fluid from a well surface to a wellbore according to one embodiment of the present invention, wherein the fluid is split into a clean stream, pumped by one or more plunger pumps and a dirty stream also pumped by one or more plunger pumps.

In response to the problems of the above pump system 200, FIG. 3 shows a pump system 300 according to one embodiment of the present invention. In such an embodiment, the fluid that is pumped from the well surface 118 to the wellbore 122 is split into a clean side 305 containing primarily water that is pumped by one or more clean pumps 301, and a dirty side 305' containing solids in a fluid carrier that is pumped by one or more dirty pumps 301'. For example, in a fracturing operation the dirty side 305' contains a proppant in a fluid carrier (such as a gel). As is explained in detail below, such a pump system 300 greatly increases the useful life of the clean pumps 301, as the clean pumps 301 are not exposed to abrasive fluids. Note that each clean pump 301 and each dirty pump 301' in the embodiment of FIG. 3 may have the same or a similar configuration as the plunger pump 101 shown in FIG. 1.

In the pump system 300 of FIG. 3, the dirty pumps 301' receive a dirty fluid in a similar manner to that described with respect to FIG. 2. That is, in the embodiment of FIG. 3, the pump system 300 includes a plurality of water tanks 321, which feed water to a gel maker 323. The gel maker 323 combines water from the tanks 321 with a gelling agent and forms a gel, which is sent to a blender 325 where it is mixed with a proppant from a proppant feeder 327 to form a dirty fluid, in this case a fracturing fluid. Exemplary proppants include sand grains, resin-coated sand grains, polylactic acids, or high-strength ceramic materials such as sintered bauxite, among other appropriate proppants.

The dirty fluid is then pumped at low pressure (for example, around 60-120 psi) from the blender 325 to the dirty pumps 301' as shown by solid lines 312', and discharged by the dirty pumps 301' at a high pressure to a common manifold or missile 310 as shown by dashed lines 314'.

On the clean side 305, water from the water tanks 321 is pumped at low pressure (for example, around 60-120 psi) directly to the clean pumps 301 by a transfer pump 331 as shown by solid lines 312, and discharged at a high pressure to the missile 310 as shown by dashed lines 314. The missile 310 receives both the clean and dirty fluids and directs their combination, which forms a fracturing fluid, to the wellbore 122 as shown by solid line 315.

If the pump system 300 shown in FIG. 3 were used in place of the pump system 200 shown in FIG. 2 (that is, in a well 120 requiring 10,000 hydraulic horsepower), and assuming that each clean pump 301 and each dirty pump 301' contains an engine 106 with a maximum rating of 2250 brake horsepower, then as in the pump system 200 of FIG. 2, each pump engine 106 in each clean and dirty pump 301/301' could be operated at about 1030 brake horsepower in order to supply the required 10,000 hydraulic horsepower to the fracturing fluid. Also, as with the pump system 200 of FIG. 2, the number of total number of pumps 301/301' in the pump system 300 of FIG. 3 may be reduced if the pump engines 106 are run at a higher brake horsepower. For example, if one of the pumps fail on either the clean side 305 or the dirty side 305', then the remaining pumps may be run at a higher speed in order to make up for the absence of the failed pump. In addition, a computerized control system 329 may be employed to direct the entire pump system 300 for the duration of the fracturing operation.

With the pump system 300 of FIG. 3, the clean pumps 301 are not exposed proppants. As a result, it is estimated that the clean pumps 301 in the pump system 300 of FIG. 3 will have a useful life of about ten times the useful life of the pumps 201 in the pump system 200 of FIG. 2. However, in order to compensate for the fact that the fluid received and discharged from the clean pumps 301 lacks proppant, the dirty pumps 301' in the pump system 300 of FIG. 3 are exposed to a greater concentration of proppant in order to obtain the same results as the pump system 200 of FIG. 2. That is, in an operation requiring a fracturing fluid with a proppant concentration of about 2 pounds per gallon to be pumped through the pumps 201 in FIG. 2, the dirty pumps 301' in the pump system 300 of FIG. 3 would need to pump a fracturing fluid with a proppant concentration of about 10 pounds per gallon. As a result, it is estimated that the useful life of the pumps 301' on the dirty side 305' of the pump system 300 of FIG. 3 would be about ⅕th the useful life of the pumps 201 in the pump system 200 of FIG. 2.

However, comparing the pump systems 200/300 from FIGS. 2 and 3, and assuming the use of the same total number of pumps in each pump system 200/300 for pumping the same concentration of proppant at the same hydraulic horsepower, the eight clean pumps 301 in the pump system 300 of FIG. 3 having a useful life of about ten times as long as the pumps 201 in the pump system 200 of FIG. 2, far outweighs the useful life of the two dirty pumps 301' in the pump system 300 of FIG. 3 being about ⅕th as long as the pumps 201 in the pump system 200 of FIG. 2. As such, the overall useful life of the pump system 300 of FIG. 3 is much greater than that of the pump system 200 of FIG. 2.

Note that it was assumed that the pump system 300 of FIG. 3 was used on a well 120 requiring 10,000 hydraulic horsepower. This was assumed merely to form a direct comparison of how the pump system 300 of FIG. 3 would perform versus how the pump system 200 of FIG. 2 would perform when acting on the same well 120. This same 10,000 hydraulic horsepower well requirement will be assumed for the pump systems 500/700/900 (described below) for the same comparative purpose. However, as described further below, it is to be understood that each of the pump systems described herein 300/500/700/900/1200 may supply any desired amount of hydraulic horsepower to a well. For example, various wells might have hydraulic horsepower requirements in the range of about 500 hydraulic horsepower to about 100,000 hydraulic horsepower, or even more.

As such, although FIG. 3 shows the pump system 300 as having eight dirty pumps 301' and two clean pumps 301, in alternative embodiments the pump system 300 may contain any appropriate number of dirty pumps 301', and any appropriate number of clean pumps 301, dependent on the hydraulic horsepower required by the well 120, the percent capacity at which it is desired to run the pump engines 106, and the amount of proppant desired to be pumped.

Also note that although two dirty pumps 301' are shown in the embodiment of FIG. 3, the pump system 300 may contain more or even less than two dirty pumps 301', the trade off being that the less dirty pumps 301' the pump system 300 has, the higher the concentration of proppant that must be pumped by each dirty pump 301'; the result of the higher concentration of proppant being the expedited deterioration of the useful life of the dirty pumps 301'. On the other hand, the fewer the dirty pumps 301', the more clean pumps 301 that can be used to obtain the same results, and as mentioned above, the expedited deterioration of the useful life of the dirty pumps 301' is far outweighed by the increased useful life of the clean pumps 301.

In the embodiment of FIG. 3, two dirty pumps 301' are shown. Although the pump system 300 could work with only one dirty pump 301', in this embodiment the pump system 300 includes two dirty pumps 301' so that if one of the dirty pumps fails, the proppant concentration in the remaining dirty pump can be doubled to make up for the absence of the failed dirty side pump.

Although the pump system 300 of FIG. 3 achieves the goal of having a longer overall useful life than the pump system 200 of FIG. 2, the pump system 300 of FIG. 3 still uses plunger pumps. Although this is a perfectly acceptable embodiment, a problem with plunger pumps is that they continually oscillate between high pressure operating conditions and low pressure operating conditions. That is, when a plunger is moved away from its fluid end, the fluid end experiences a low pressure; and when a plunger is moved toward its fluid end, the fluid end experiences a high pressure. This oscillating pressure on the fluid end places the fluid end (as well as it internal components) under a tremendous amount of strain which eventually results in fatigue failures in the fluid end.

In addition, plunger pumps generate torque pulsations and pressure pulsations, these pulsations being proportional to the number of plungers in the pump, with the higher the number of plungers, the lower the pulsations. However, increasing the number of plungers comes at a significant cost in terms of mechanical complexity and increased cost to replace the valves, valve seats, packings, plungers, etc. On the other hand, the pulsations created by plunger pumps are the main cause of transmission 110 failures, which fail fairly frequently, and the transmission 110 is even more difficult to replace than the pump fluid end 108 and is comparable in cost.

The pressure pulses in plunger pumps are large enough that if the high pressure pump system goes into resonance, parts of the pumping system will fail in the course of a single job. That is, components such as the missile or treating iron can fail catastrophically. This pressure pulse problem is even worse when multiple pumps are run at the same or very similar speeds. As such, in a system using multiple plunger pumps, considerable effort has to be devoted to running all of the pumps at different speeds to prevent resonance, and the potential for catastrophic failure.

Multistage centrifugal pumps, on the other hand, can receive fluid at a low pressure and discharge it at a high pressure while exposing its internal components to a fairly constant pressure with minimal variation at each stage along its length. The lack of large pressure variations means that the pressure housing of the centrifugal pump does not experience significant fatigue damage while pumping. As a result, when pumping clean fluids, multistage centrifugal pump systems generally exhibit higher life expectancy, and lower operational costs than plunger pumps. In addition, multistage centrifugal pump systems also tend to wear out and lose efficiency gradually, rather than failing catastrophically as is more typical with plunger pumps and their associated transmissions. Therefore, in some situations when pumping a clean fluid it may be desired to use multistage centrifugal pumps rather than plunger pumps.

Figure 4:
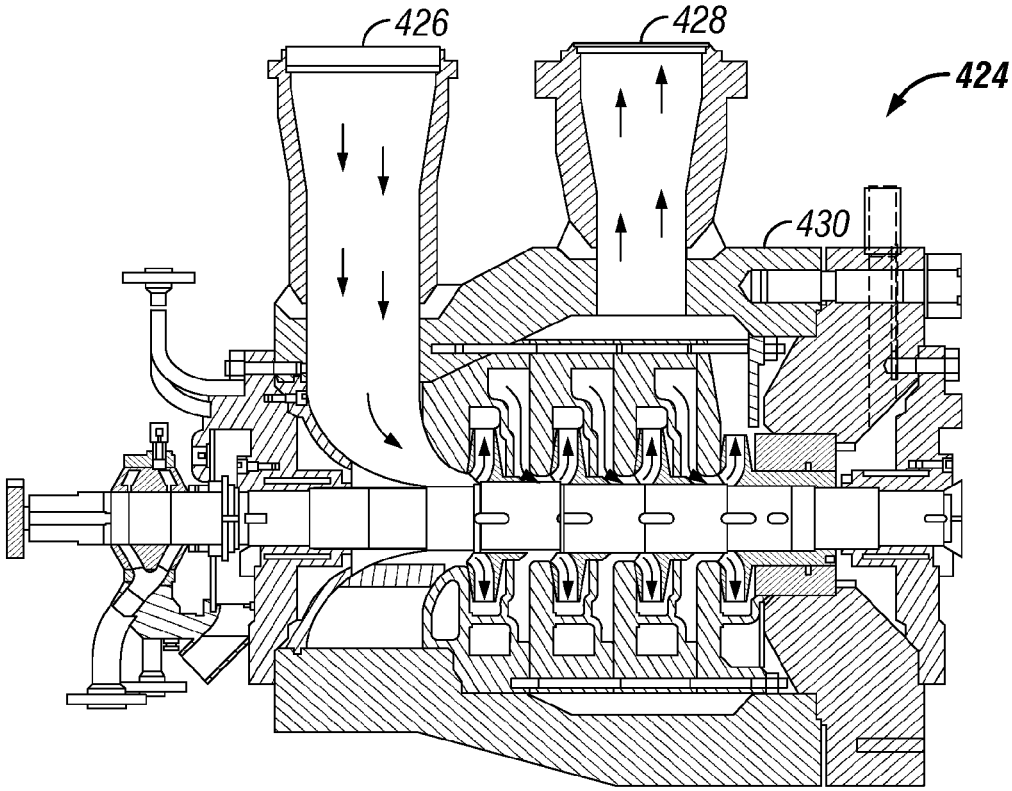
FIG. 4 is a side cross-sectional view of a multistage centrifugal pump.

FIG. 4 shows an example of a multistage centrifugal pump 424. As shown, the multistage centrifugal pump 424 receives a fluid through an intake pipe 426 at a low pressure and discharges it through a discharge pipe 428 at a high pressure by passing the fluid (as shown by the arrows) along a long cylindrical pipe or barrel 430 having a series of impellers or rotors 432. That is, as the fluid is propelled by each successive impeller 432, it gains more and more pressure until it exits the pump at a much higher pressure than it entered. To create a multistage centrifugal pump with a greater pressure output, the diameter of the impellers 432 may be increased and/or the number of impellers 432 (also referred to as the number of stages of the pump) may be increased.

As such it may be desirable to create a pumping system similar to that of FIG. 3, but using multistage centrifugal pumps as the clean pumps rather than plunger pumps as the clean pumps. Such a configuration in shown in the pump system 500 of FIG. 5. Note that many portions of the pump system 500 of FIG. 5 may generally operate in the same manner as described above with respect to the pump system 300 of FIG. 3. Therefore, the operations of the pump system 500 of FIG. 5 that are similar to the operations described above with respect to the pump system 300 of FIG. 3 are not repeated here to avoid duplicity. However, as mentioned above, a difference between the pump system 500 of FIG. 5 and the pump system 300 of FIG. 3 is that the clean pumps 501 on the clean side 305 of the pump system 500 of FIG. 5 are multistage centrifugal pumps rather than plunger pumps.

Figure 6:
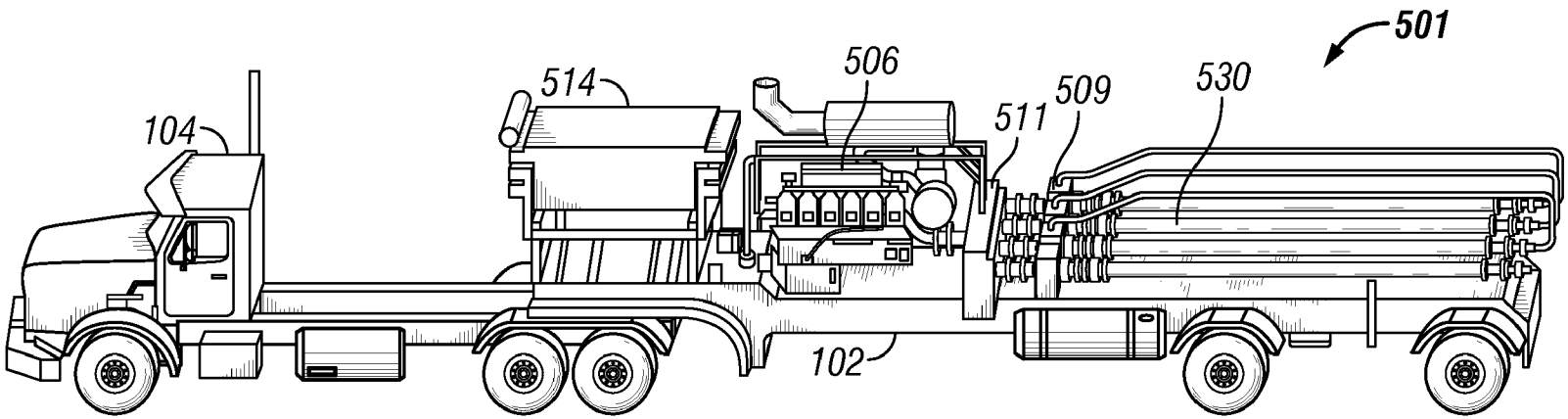
FIGS. 6, 8 and 10 each show a top perspective view of a multistage centrifugal pump for use in a pump system according to one embodiment of the present invention.

In this embodiment, each clean pump 501 may have the same or a similar configuration as the multistage centrifugal pump 501 shown in FIG. 6. As shown in FIG. 6, the multistage centrifugal pump 501 is mounted on a standard trailer 102 for ease of transportation by a tractor 104. The multistage centrifugal pump 501 includes a prime mover 506 that drives the impellers contained therein through a gearbox 511. Also connected to the prime mover 506 is a radiator 514 for cooling the prime mover 506. In addition, the multistage centrifugal pump 501 includes four centrifugal pump barrels 530 connected in series by a high pressure interconnecting manifold 509. In this embodiment, each pump barrel 530 contains forty impellers having a diameter of approximately 5-11 inches. An example of such a pump barrel 530 is commercially available from Reda Pump Co. of Singapore (i.e., a Reda 675 series HPS pump barrel with 40 stages.)

Figure 5:
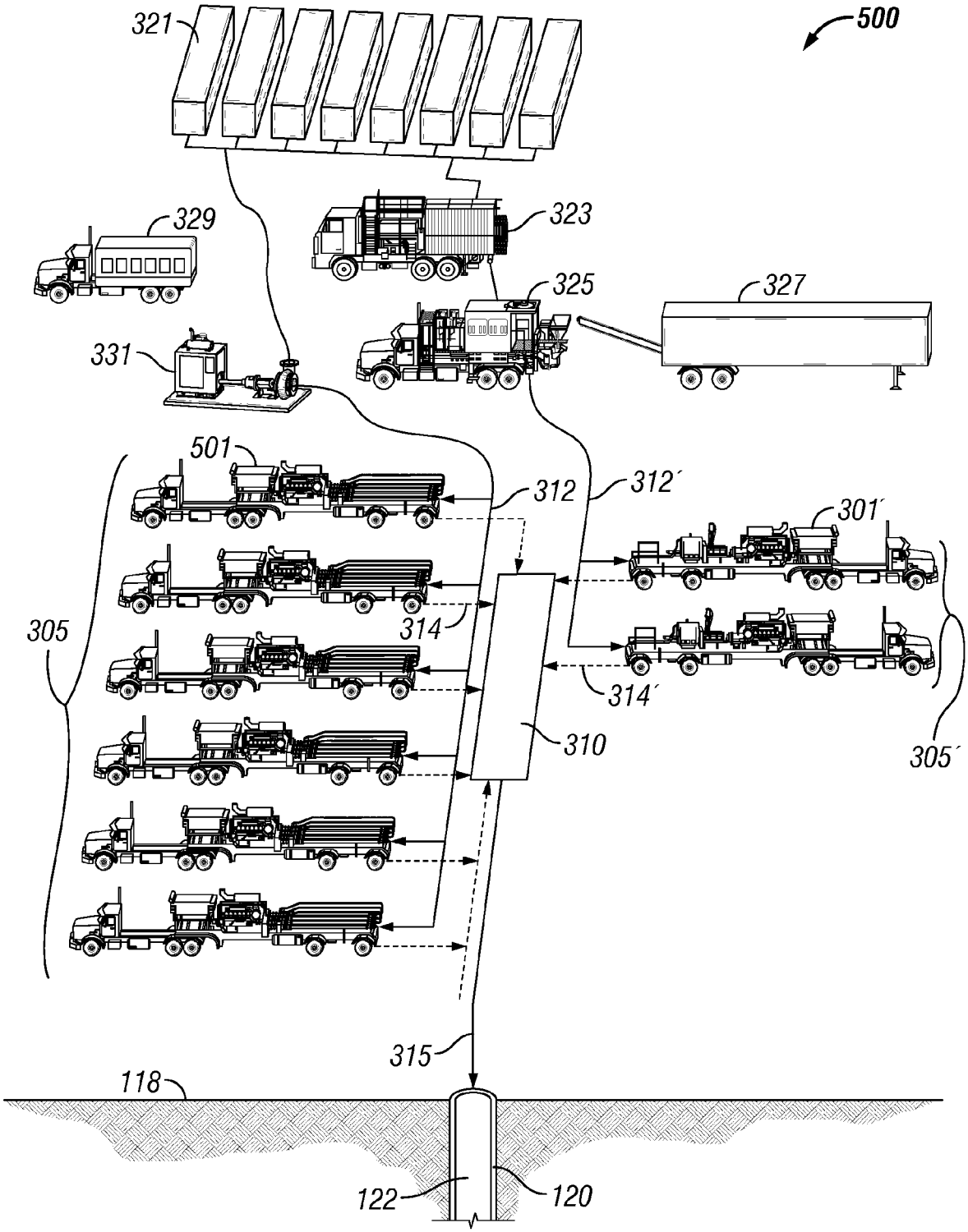
FIGS. 5, 7, and 9 each show a schematic representation of a pump system for pumping a fluid from a well surface to a wellbore according to one embodiment of the present invention, wherein the fluid is split into a clean stream, pumped by one or more multistage centrifugal pumps, and a dirty stream pumped by one or more plunger pumps.

In one embodiment, the prime mover 506 in each multistage centrifugal pump 501 in the pump system 500 of FIG. 5 is a diesel engine with a maximum rating of 2250 brake horsepower, which when accounting for losses (typically about 30% for multistage centrifugal pumps in hydraulic fracturing operations), allows each clean pump 501 in the pump system 500 of FIG. 5 to supply a maximum of about 1575 hydraulic horsepower to the fracturing fluid. Therefore, in order to supply 10,000 hydraulic horsepower to a fracturing fluid, assuming each dirty pump 301' supplies about 1000 hydraulic horsepower to the fracturing fluid (as assumed in the pump systems 200 and 300 of FIGS. 2 and 3), the pump system 500 of FIG. 5 would require six multistage centrifugal pump 501, each supplying 1575 hydraulic horsepower to obtain a total of about 11,450 hydraulic horsepower.

Note that the excess available 1,450 hydraulic horsepower over the required 10,000 hydraulic horsepower allows one of the pumps 501/301' in the pump system 500 of FIG. 5 to fail with the remaining pumps 501/301' making up for the absence of the failed pump, and/or allows the clean pumps 501 to operate at less than full power. Note, however, that since the multistage centrifugal pumps 501 of FIG. 5 do not contain a transmission, they can be run at full power without fear of failure. As such, in order for the pump system 500 of FIG. 5 to pump the same concentration of proppant at the same hydraulic horsepower as the pump system 200 of FIG. 2, two less total pumps are required. In addition, the clean pumps 501 in the pump system 500 of FIG. 5 are likely to last longer than the pumps 201 in the pump system 200 of FIG. 2.

Figure 7:
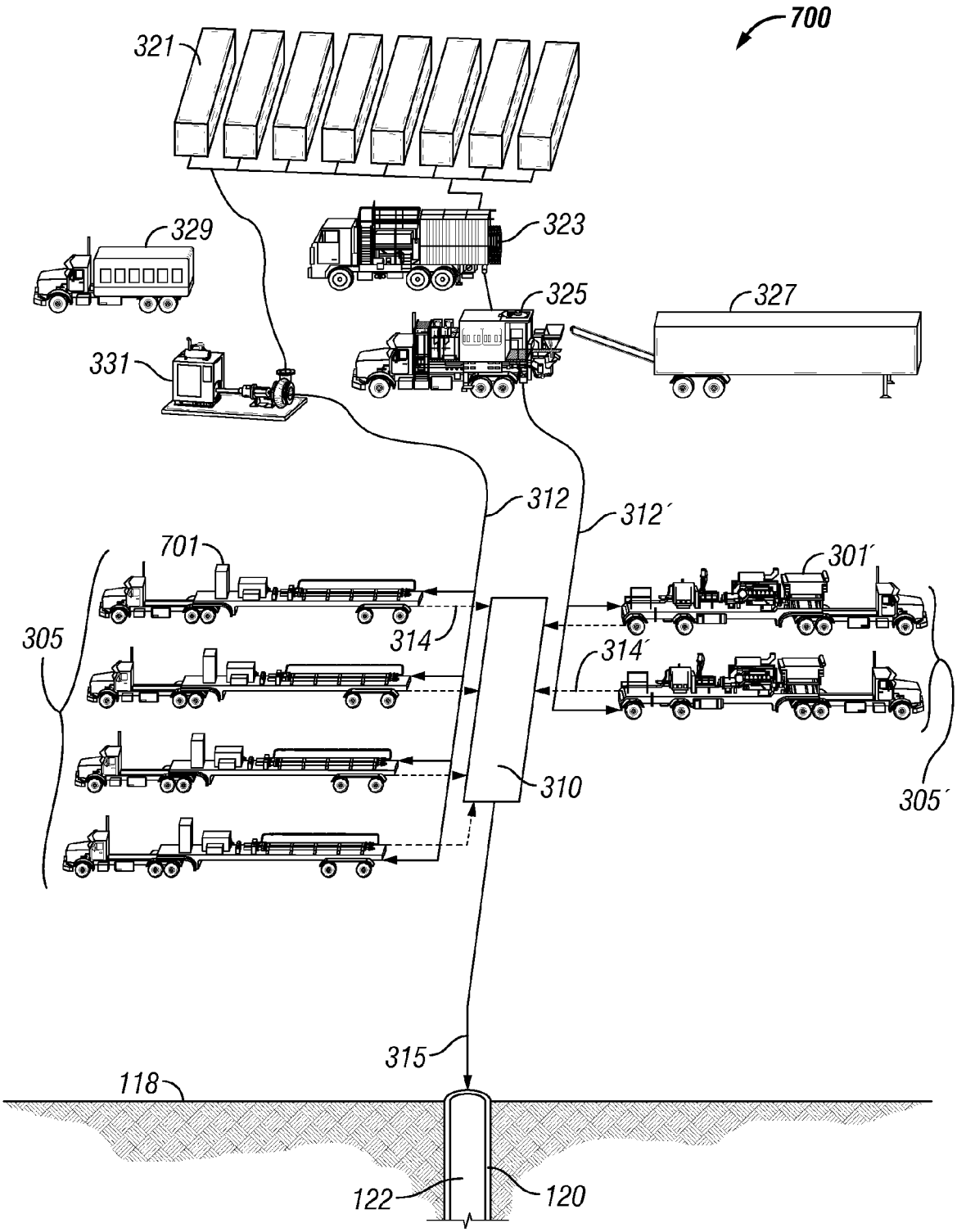

FIG. 7 shows an embodiment similar to that shown in FIG. 5, but with differently configured clean pumps 701. Note that many portions of the pump system 700 of FIG. 7 may generally operate in the same manner as described above with respect to the pump system 300 of FIG. 3. Therefore, the operations of the pump system 700 of FIG. 7 that are similar to the operations described above with respect to the pump system 300 of FIG. 3 are not repeated here to avoid duplicity. However, as mentioned above, a difference between the pump system 700 of FIG. 7 and the pump system 300 of FIG. 3 is that the clean pumps 701 on the clean side 305 of the pump system 700 of FIG. 7 are multistage centrifugal pumps rather than plunger pumps. In addition, although the clean pumps 501/701 in the pump systems 500/700 of both FIGS. 5 and 7 are multistage centrifugal pumps, the multistage centrifugal pumps in the pump system 700 of FIG. 7 are configured differently than the multistage centrifugal pumps of FIG. 5.

Figure 8:
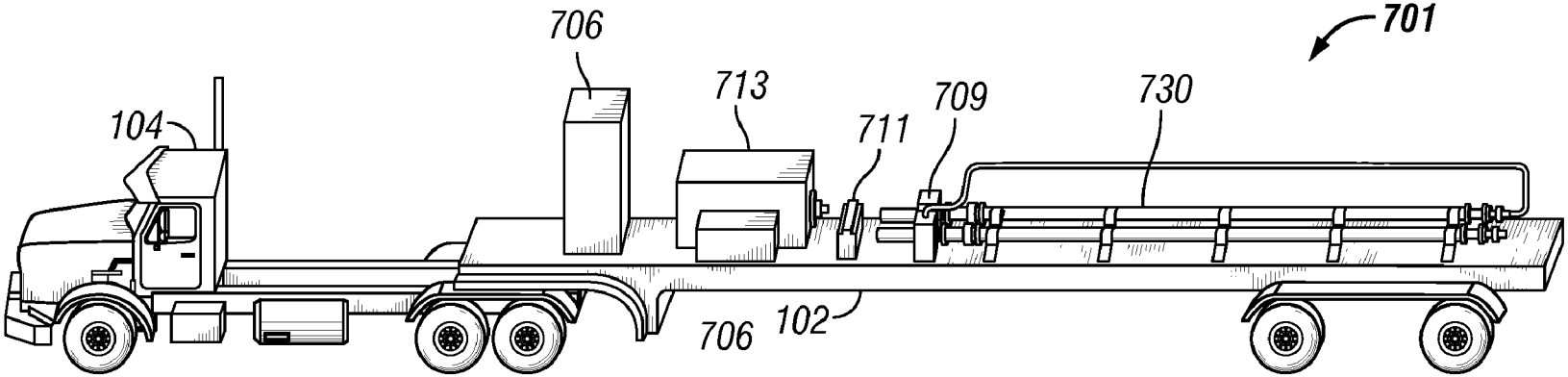

For example, in the embodiment of FIG. 7, each clean pump 701 may have the same or a similar configuration as the multistage centrifugal pump 701 shown in FIG. 8. As shown in FIG. 8, the multistage centrifugal pump 701 is mounted on a standard trailer 102 for ease of transportation by a tractor 104. The multistage centrifugal pump 701 includes a prime mover 706 that drives the impellers contained therein through a gearbox 711 and a transfer box 713. In addition, the multistage centrifugal pump 701 includes two centrifugal pump barrels 730 connected in series by a high pressure interconnecting manifold 709. In this embodiment, each pump barrel 730 contains 76 impellers having a diameter of approximately 5-11 inches. An example of such a pump barrel 730 is commercially available from Reda Pump Co. of Singapore (i.e., a Reda series 862 HM520AN HPS pump barrel with 76 stages.)

In one embodiment, the prime mover 706 in each multistage centrifugal pump 701 in the pump system 700 of FIG. 7 is an electric motor with a maximum rating of 3500 brake horsepower, which when accounting for losses (typically about 30% for multistage centrifugal pumps in hydraulic fracturing operations), allows each clean pump 701 in the pump system 700 of FIG. 7 to supply a maximum of about 2450 hydraulic horsepower to the fracturing fluid. Therefore, in order to supply 10,000 hydraulic horsepower to a fracturing fluid, assuming each dirty pump 301' supplies about 1000 hydraulic horsepower to the fracturing fluid (as assumed in the pump systems 200 and 300 of FIGS. 2 and 3), the pump system 700 of FIG. 7 would require four multistage centrifugal pumps 701 each supplying 2450 hydraulic horsepower in order to obtain a total of about 11,880 hydraulic horsepower.

Note that the excess available 1,880 hydraulic horsepower over the required 10,000 hydraulic horsepower allows one of the pumps 701/301' in the pump system 700 of FIG. 7 to fail with the remaining pumps 701/301' making up for the absence of the failed pump, and/or allows the clean pumps 701 to operate at less than full power. Note, however, that since the multistage centrifugal pumps 701 of FIG. 7 do not contain a transmission, they can be run at full power without fear of failure. As such, in order for the pump system 700 of FIG. 7 to pump the same concentration of proppant at the same hydraulic horsepower as the pump system 200 of FIG. 2, four less total pumps are required. In addition, the clean pumps 701 in the pump system 700 of FIG. 7 are likely to last longer than the pumps 201 in the pump system 200 of FIG. 2.

Figure 9:
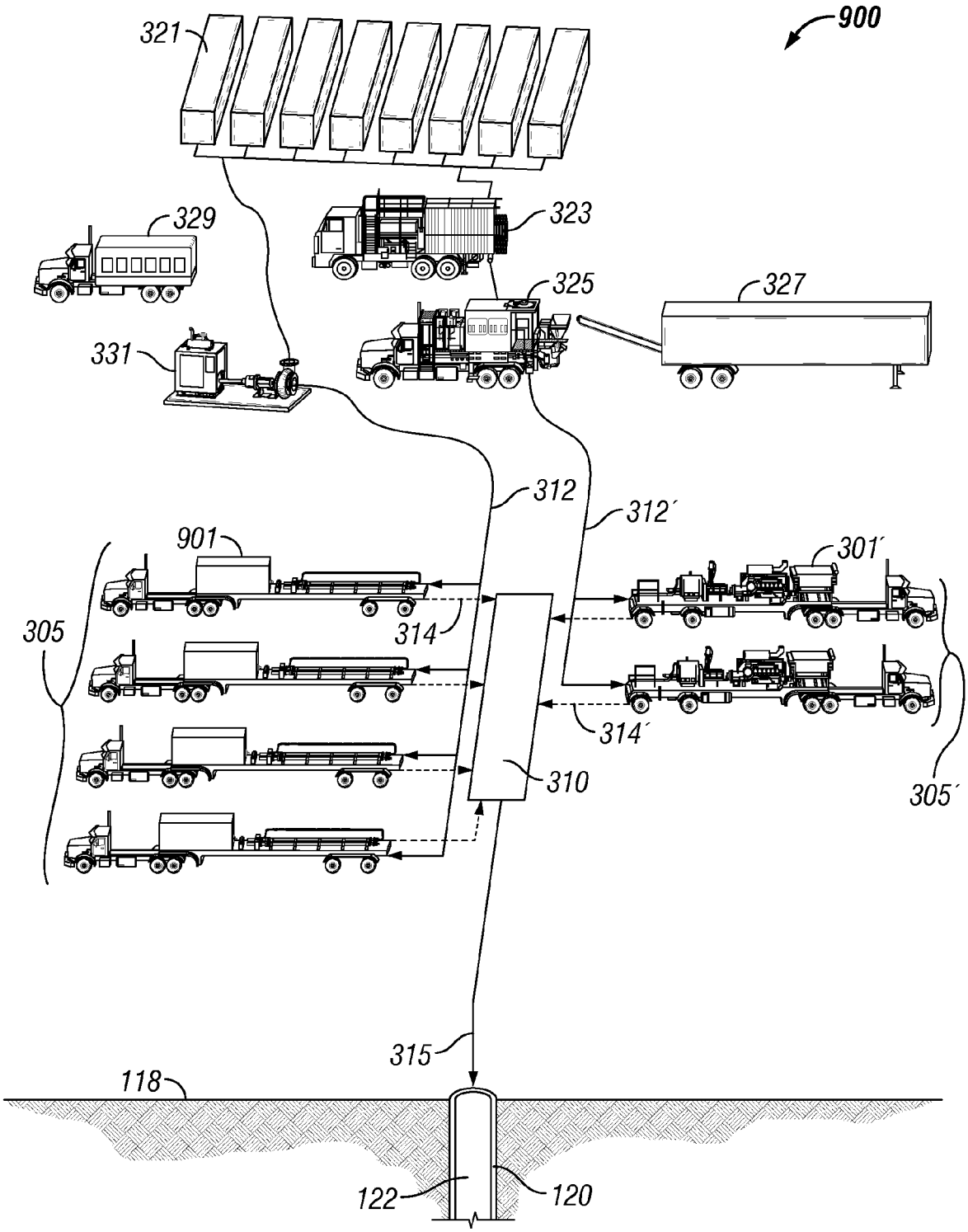

FIG. 9 shows an embodiment similar to that shown in FIG. 5, but with yet another configuration of clean pumps 901. Note that many portions of the pump system 900 of FIG. 9 may generally operate in the same manner as described above with respect to the pump system 300 of FIG. 3. Therefore, the operations of the pump system 900 of FIG. 9 that are similar to the operations described above with respect to the pump system 300 of FIG. 3 are not repeated here to avoid duplicity. However, as mentioned above, a difference between the pump system 900 of FIG. 9 and the pump system 300 of FIG. 3 is that the clean pumps 901 on the clean side 305 of the pump system 900 of FIG. 9 are multistage centrifugal pumps rather than plunger pumps. In addition, although the clean pumps 501/901 in the pump systems 500/900 of both FIGS. 5 and 9 are multistage centrifugal pumps, the multistage centrifugal pumps in the pump system 900 of FIG. 9 are configured differently than the multistage centrifugal pumps of FIG. 5.

Figure 10:
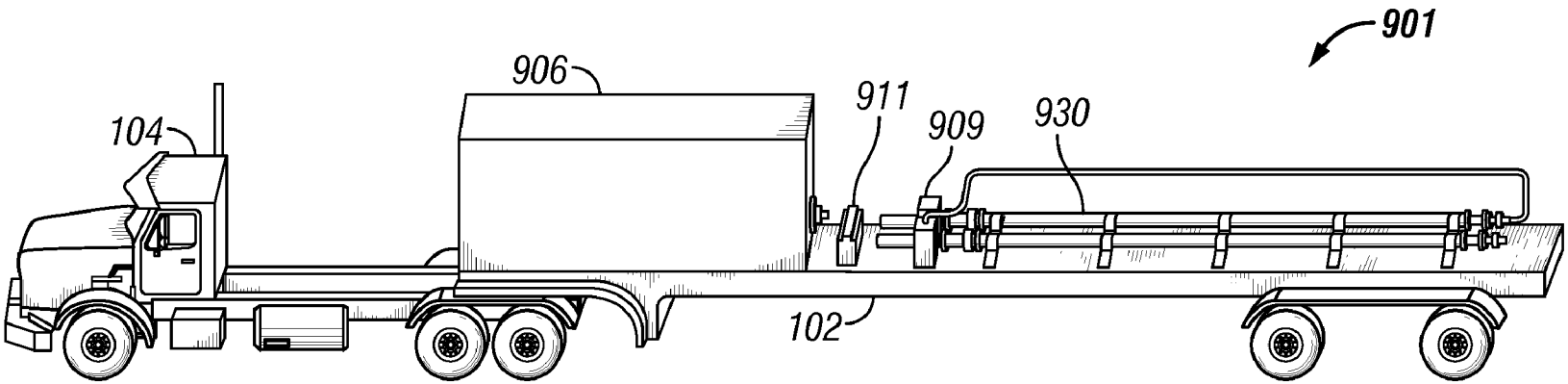

For example, in the embodiment of FIG. 9, each clean pump 901 may have the same or a similar configuration as the multistage centrifugal pump 901 shown in FIG. 10. As shown in FIG. 10, the multistage centrifugal pump 901 is mounted on a standard trailer 102 for ease of transportation by a tractor 104. The multistage centrifugal pump 901 includes a prime mover 906 that drives the impellers contained therein through a gearbox 911. In addition, the multistage centrifugal pump 901 includes two centrifugal pump barrels 930 connected in series by a high pressure interconnecting manifold 909. In this embodiment, each pump barrel 930 contains 76 impellers having a diameter of approximately 5-11 inches. An example of such a pump barrel 930 is commercially available from Reda Pump Co. of Singapore (i.e., a Reda series 862 HM520AN HPS pump barrel with 76 stages.)

In one embodiment, the prime mover 906 in each multistage centrifugal pump 901 in the pump system 900 of FIG. 9 is a turbine engine with a maximum rating of 3500 brake horsepower, which when accounting for losses (typically about 30% for multistage centrifugal pumps in hydraulic fracturing operations), allows each clean pump 901 in the pump system 900 of FIG. 9 to supply a maximum of about 2450 hydraulic horsepower to the fracturing fluid. Therefore, in order to supply 10,000 hydraulic horsepower to a fracturing fluid, assuming each dirty pump 301' supplies about 1000 hydraulic horsepower to the fracturing fluid (as assumed in the pump systems 200 and 300 of FIGS. 2 and 3), the pump system 900 of FIG. 9 would require four multistage centrifugal pumps 901 each supplying 2450 hydraulic horsepower to obtain a total of about 11,880 hydraulic horsepower.

Note that the excess available 1,880 hydraulic horsepower over the required 10,000 hydraulic horsepower allows one of the pumps 901/301' in the pump system 900 of FIG. 9 to fail with the remaining pumps 901/301' making up for the absence of the failed pump, and/or allows the clean pumps 901 to operate at less than full power. However, note that since the multistage centrifugal pumps 901 of FIG. 9 do not contain a transmission, they can be run at full power without fear of failure. As such, in order for the pump system 900 of FIG. 9 to pump the same concentration of proppant at the same hydraulic horsepower as the pump system 200 of FIG. 2, four less total pumps are required. In addition, the clean pumps 901 in the pump system 900 of FIG. 9 are likely to last longer than the pumps 201 in the pump system 200 of FIG. 2.

Note, in each of the embodiments of FIGS. 5, 7 and 9, the pump barrels 530/730/930 are shown connected in series, however, in alternative embodiments the pump barrels 530/730/930 in any of the embodiments of FIGS. 5, 7, and 9 may be connected in parallel, or in any combination of series and parallel. However, an advantage of having the barrels 530/730/930 arranged in a series configuration is that the fluid leaves each successive barrel 530/730/930 at a higher pressure, whereas in a parallel configuration the fluid leaves each barrel 530/730/930 at the same pressure.

Figure 11:
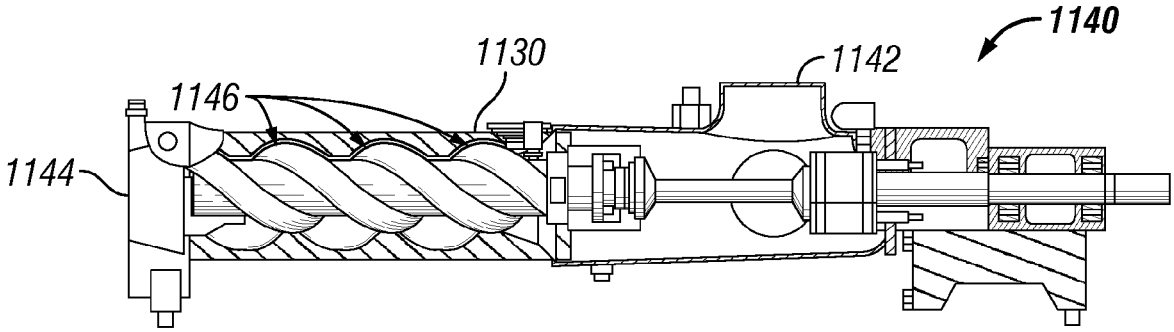
FIG. 11 is a side cross-sectional view of a progressing cavity pump.

Progressing cavity pumps have characteristics very similar to multistage centrifugal pumps, and therefore may be desirable for use in pump systems according to the present invention. FIG. 11 shows an example of a progressing cavity pump 1140. As shown, the progressing cavity pump 1140 receives a fluid through an intake pipe 1142 at a low pressure and discharges it through a discharge pipe 1144 at a high pressure by passing the fluid along a long cylindrical pipe or barrel 1130 having a series of twists 1146 (also referred to as turns or stages). That is, as the fluid is propelled by each successive twist 1146, it gains more and more pressure until it exits the pump 1140 at a much higher pressure than it entered. To create a progressing cavity pump with a greater pressure output, the diameter of the twists 432 may be increased and/or the number of twist 432 (also referred to as the number of stages of the pump) may be increased. Suitable progressing cavity pumps for oilwell operations, such as hydraulic fracturing operations, include the Moyno 962ERT6743, and the Moyno 108-T-315, among other appropriate pumps.

As such, in any of the embodiments described above, the clean pumps 301 may be replaced with progressing cavity pumps. In addition, progressing cavity pumps are capable of handling very high solids loadings, such as the proppant concentrations in typical hydraulic fracturing operations. Consequently, in any of the embodiments described above, the dirty pumps 301' may be replaced with progressing cavity pumps. In addition, in any of the embodiments described above, the clean pumps 301 may include any combination of plunger pumps, multistage centrifugal pumps and progressing cavity pumps; and the dirty pumps may similarly include any combination of plunger pumps, multistage centrifugal pumps and progressing cavity pumps.

Note also that in each of the above pump system embodiments 200/300/500/700/900 it was assumed that the accompanying well 120 required 10,000 hydraulic horsepower. This was assumed so that each of the pump systems 200/300/500/700/900 could be directly compared to each other. However, in each of the pump systems 300/500/700/900 described above the total output hydraulic horsepower may be increased/decreased by using a prime mover 106/506/706/906 with a larger/smaller horsepower output, and/or by increasing/decreasing the total number of pumps in the pump system 300/500/700/900. With these modifications, each of the pump systems 300/500/700/900 described above may supply a hydraulic horsepower in the range of about 500 hydraulic horsepower to about 100,000 hydraulic horsepower, or even more if needed.

In various embodiments, the prime mover 106/506/706/906 in any of the above described pump systems 300/500/700/900 may be a diesel engine, a gas turbine, a steam turbine, an AC electric motor, a DC electric motor. In addition, any of these prime movers 106/506/706/906 may have any appropriate power rating.

Figure 12:
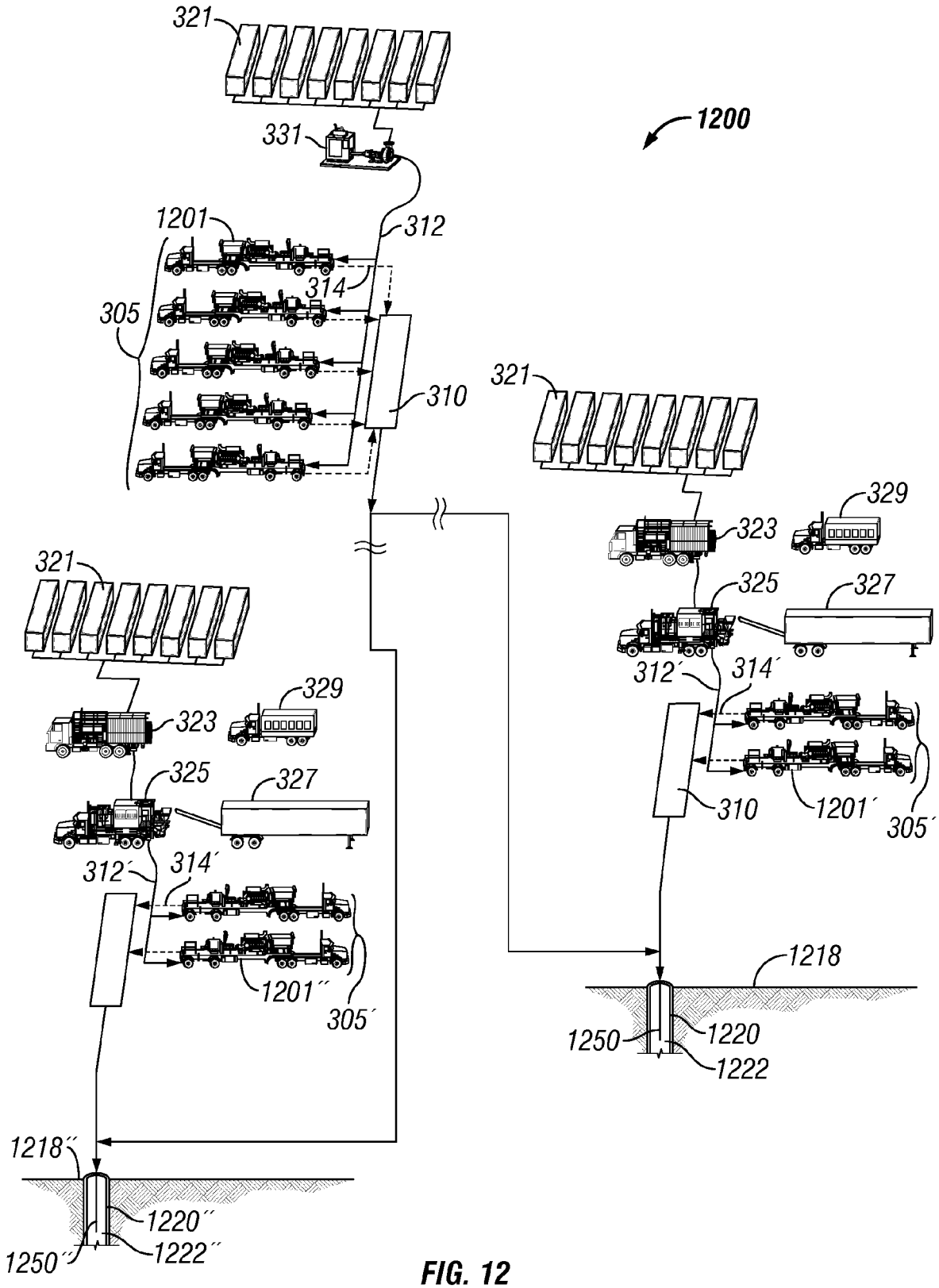
FIG. 12 is a schematic representation of a pump system for pumping a fluid from a well surface to a wellbore according to one embodiment of the present invention, wherein the fluid is split into a clean stream pumped by one or more clean pumps that are remotely located from the wellbore, and a dirty stream.

FIG. 12 shows another embodiment of a pump system 1200 according to the present invention wherein the fluid to be pumped (such as a fracturing fluid) is split into a clean side 305 containing primarily water that is pumped by one or more clean pumps 1201, and a dirty side 305' containing solids in a fluid carrier (for example, a proppant in a gelled water) that is pumped by one or more dirty pumps 1201'.

In the embodiment of FIG. 12, the clean side pumps 1201 may operate in the same manner as any of the embodiments for the clean side pumps 301/501/701/901 described above, and therefore may contain one or more plunger pumps 301; one or more multistage centrifugal pumps 501/701/901; one or more progressing cavity pumps 1140; or any appropriate combination thereof. Similarly, the dirty side pumps 1201' may operate in the same manner as any of the embodiments of the dirty side pumps 301' described above, and therefore may contain one or more plunger pumps 301; one or more multistage centrifugal pumps 501/701/901; one or more progressing cavity pumps 1140; or any appropriate combination thereof.

However, in contrast to the embodiments disclosed above, in the pump system 1200 of FIG. 12, the clean side pumps 1201 may be remotely located from the dirty side pumps 1201'/1201". In addition, the clean side pumps 1201 may be used to supply a clean fluid to more than one wellbore. For example, in the embodiment of FIG. 12, the clean side pumps 1201 are shown remotely located from, and supplying a clean fluid to, the wellbores 1222 and 1222' of both a first well 1220 and a second well 1220'. Such a configuration significantly reduces the required footprint in the area around the wells 1218 and 1218" since only one set of clean side pumps 1201 is used to treat both wellbores 1222 and 1222".

However, it should be noted that in alternative embodiments, the clean side pumps 1201 may be remotely connected to a single well, or remotely connected to any desired number of multiple wells, with each of the multiple wells being either directly connected to one or more dedicated dirty side pumps or remotely connected to one or more remotely located dirty side pumps. In addition, in further embodiments, one or more dirty pumps may be remotely connected to a single well or remotely connected to any desired number of multiple wells. Also, the well treating lines 1250 and 1250" used to connect the pumps 1201/1201'/1201" to the wellbores 1222/1222" may be used as production lines when it is desired to produce the well. In one embodiment, the clean side pumps 1201 may be remotely located by a distance anywhere in the range of about one thousand feet to several miles from the well(s) 1201/1201' to which they supply a clean fluid.

Although the above described embodiments focus primarily on pump systems that use dirty pumps to pump a fracturing fluid during a hydraulic fracturing operation, in any of the embodiments of the pump systems described above the dirty pumps may be used to pump any fluid or gas that may be considered to be more corrosive to the dirty pumps than water, such as acids, petroleum, petroleum distillates (such as diesel fuel), liquid Carbon Dioxide, liquid propane, low boiling point liquid hydrocarbons, Carbon Dioxide, an Nitrogen, among others.

In addition, the dirty pumps in any of the embodiments described above may be used to pump minor additives to change the characteristics of the fluid to be pumped, such as materials to increase the solids carrying capacity of the fluid, foam stabilizers, pH changers, corrosion preventers, and/or others. Also, the dirty pumps in any of the embodiments described above may be used to pump solid materials other than proppants, such as particles, fibers, and materials having manufactured shapes, among others. In addition, either the clean or the dirty pumps in any of the embodiments described above may be used to pump production chemicals, which includes any chemicals used to modify a characteristic of the well formation of a production fluid extracted therefore, such as scale inhibitors, or detergents, among other appropriate production chemicals.

The preceding description has been presented with reference to presently preferred embodiments of the invention. Persons skilled in the art and technology to which this invention pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims, which are to have their fullest and fairest scope.

The invention claimed is:

1. A method of pumping an oilfield fluid from a well surface to a wellbore comprising:

operating at least one clean pump to pump a clean stream to a common manifold positioned at the well surface, said clean stream comprising primarily water;

operating at least one dirty pump to pump a dirty stream to the common manifold, said dirty stream comprising a solid material disposed in a fluid carrier; and combining the clean stream and the dirty stream in the common manifold to form the oilfield fluid, and introducing the oilfield fluid to the wellbore.

2. The method of claim 1, wherein the clean pump is a same type of pump as the dirty pump.

3. The method of claim 2, wherein the clean pump and the dirty pump are each a plunger pump.

4. The method of claim 1, wherein the clean pump is a different type of pump from the dirty pump.

5. The method of claim 4, wherein the clean pump is a multistage centrifugal pump and the dirty pump is a plunger pump.

6. The method of claim 5, wherein the clean pump is a progressing cavity pump and the dirty pump is a plunger pump.

7. The method of claim 1, wherein more clean pumps are operated than dirty pumps.

8. The method of claim 1, wherein a concentration of the solid material in the dirty stream is about 10 pounds per gallon.

9. The method of claim 1, wherein the solid material is a proppant and wherein the oilfield fluid is a fracturing fluid.

10. The method of claim 1, wherein the solid material is one of a particle, a fiber and a material having a manufactured shape.

11. A system for pumping an oilfield fluid from a well surface to a wellbore, said system comprising, at the well surface:

a clean stream comprising primarily water;

a dirty stream comprising a corrosive material, a gelling agent, and water;

a common manifold that is connected to the clean stream and the dirty stream, said common manifold combining the clean stream and the dirty stream to form the oilfield fluid;

a water tank at the well surface for supplying water to the dirty stream; and a gel maker at the well surface that receives the water from the water tank and mixes the water and the gelling agent.

12. The system of claim 11, further comprising a water tank at the well surface for supplying water to the clean stream.

13. The system of claim 12, further comprising at least one clean pump at the well surface for pumping the clean stream to the common manifold, wherein said clean pump is connected to the water tank at one end and to the common manifold at another end.

14. The system of claim 13, wherein at least one clean pump is a multistage centrifugal pump, a progressing cavity pump, or a plunger pumps.

15. The system of claim 11, further comprising a blender at the well surface that receives a mixture of the water and the gelling agent from the gel maker and further combines the mixture with the corrosive material to form the dirty stream.

16. The system of claim 15, further comprising at least one dirty pump at the well surface for pumping the dirty stream to the common manifold, wherein said dirty pump is connected to the blender at one end and to the common manifold at another end.

17. The system of claim 16, wherein at least one dirty pump is a plunger pump.

18. The system of claim 11, wherein the common manifold is further connected to the wellbore for introducing the oilfield fluid into the wellbore.

* * * * *